US008522973B2

(12) United States Patent
Joseph

(10) Patent No.: US 8,522,973 B2
(45) Date of Patent: Sep. 3, 2013

(54) TOOTHBRUSH HOLDER HAVING ILLUMINATING MEANS

(76) Inventor: Dephillia J. McClenon Joseph, Houston, TX (US)

( * ) Notice: Subject to any disclaimer, the term of this patent is extended or adjusted under 35 U.S.C. 154(b) by 267 days.

(21) Appl. No.: 13/134,772

(22) Filed: Jun. 16, 2011

(65) Prior Publication Data

US 2012/0318689 A1 Dec. 20, 2012

(51) Int. Cl.
*B65D 83/10* (2006.01)

(52) U.S. Cl.
USPC ..... 206/362.2

(58) Field of Classification Search
USPC ..... 206/349, 361, 362.2, 15.2, 362.3, 206/769, 770, 776, 781, 822, 823
See application file for complete search history.

(56) References Cited

U.S. PATENT DOCUMENTS

| | | | | |
|---|---|---|---|---|
| 1,451,425 | A * | 4/1923 | Hurley | 206/209.1 |
| 1,459,831 | A * | 6/1923 | Jones | 206/209.1 |
| 2,538,337 | A * | 1/1951 | Spears | 206/362.2 |
| 2,592,131 | A * | 4/1952 | Farrar | 250/455.11 |
| 3,274,631 | A * | 9/1966 | Spohr | 15/22.1 |
| 2004/0126274 | A1* | 7/2004 | Song et al. | 422/26 |
| 2005/0030163 | A1* | 2/2005 | Shiner et al. | 340/309.16 |
| 2008/0202960 | A1* | 8/2008 | Donohue | 206/362.3 |
| 2011/0100865 | A1* | 5/2011 | Brink et al. | 206/581 |
| 2012/0298676 | A1* | 11/2012 | Cooks | 220/592.21 |

* cited by examiner

*Primary Examiner* — Jacob K Ackun
(74) *Attorney, Agent, or Firm* — Stephen Griener

(57) ABSTRACT

A toothbrush holder is disclosed. The toothbrush holder includes a tubular body that is sized to contain a toothbrush. The tubular body is formed of a light-transmissive material and has a lower segment and an upper segment that are releasably secured together so that the toothbrush can be positioned inside. A weighted base is affixed to the bottom of the lower segment. A cap is affixed to the top of the upper segment and is formed of a light-transmissive material. A light source is secured within the cap.

6 Claims, 4 Drawing Sheets

TOOTHBRUSH HOLDER HAVING ILLUMINATING MEANS

FIELD OF THE INVENTION

The present invention relates generally to special receptacles or packages for tools, e.g., brushes.

BACKGROUND OF THE INVENTION

The toothbrush is a tool for cleaning the teeth and gums having a cluster of bristles secured to one end of a handle to facilitate the cleansing of hard-to-reach areas of the mouth. Toothbrushes are available with different bristle textures, sizes and forms. Some toothbrushes even have motors that vibrate or rotate their bristles to make brushing easier and more effective.

Dentists recommend that everyone brush their teeth after meals to prevent tooth decay. Toothpaste is usually applied to the bristles of the toothbrush prior to brushing though, in reality, all that is required is water. Generally, teeth and gums are thoroughly brushed in a matter of minutes. Afterward, the toothbrush is suspended above a bathroom sink where it is permitted to air dry for hours or days. Nothing is usually done to limit the spread of germs to the toothbrush as it awaits its next use.

The use of a sink and toilet in a bathroom tends to produce germ-carrying droplets that can travel many feet through the air. Not only do these droplets fall on the floor, countertops, and cabinetry in a bathroom, but they also hit uncovered toothbrushes. Of course, the spread of germs to toothbrushes can cause severe illnesses and even death. A need, therefore, exists for a convenient tool that covers a toothbrush between uses.

SUMMARY OF THE INVENTION

In light of the problems associated with toothbrushes as they are typically used, it is a principal object of the invention to provide a toothbrush holder that protects the entirety of one toothbrush, either manually operated or electric, from airborne germs. The holder reduces the likelihood of a user of a protected toothbrush from becoming sick.

It is another object of my invention to provide a toothbrush holder of the type described that can be selectively illuminated so that it can be easily found in dark environments or even serve as a nightlight in homes, dormitory rooms, hospitals, etc.

It is a further object of the invention of the invention to provide a toothbrush holder of the type described that permit air to flow to a protected toothbrush thereby allowing the toothbrush to quickly dry, robbing germs of an aqueous environment within which they might multiply.

It is another object of the invention to provide a toothbrush holder having illuminating means that can be deployed and used with minimal instruction and without resort to any tools.

It is an object of the invention to provide improved features and arrangements thereof in a toothbrush holder for the purposes described that is: lightweight in construction, inexpensive to manufacture, so attractive that it blends into any decor, and dependable in use.

My toothbrush holder achieves the intended objects by featuring a tubular body that is sized to contain a toothbrush. The tubular body is formed of a light-transmissive material and has a lower segment and an upper segment that are releasably secured together so that the toothbrush can be positioned inside. A weighted base is affixed to the bottom of the lower segment. A cap is affixed to the top of the upper segment and is formed of a light-transmissive material. A light source is secured within the cap.

The foregoing and other objects, features, and advantages of my toothbrush holder will become readily apparent upon consideration of the following description of the preferred holder embodiment illustrated in the accompanying drawings.

BRIEF DESCRIPTION OF THE DRAWINGS

My toothbrush holder can be more readily understood with reference to the accompanying drawings, in which.

Similar reference characters denote corresponding features consistently throughout the accompanying drawings.

DETAILED DESCRIPTION OF THE PREFERRED EMBODIMENT

Figure 1:
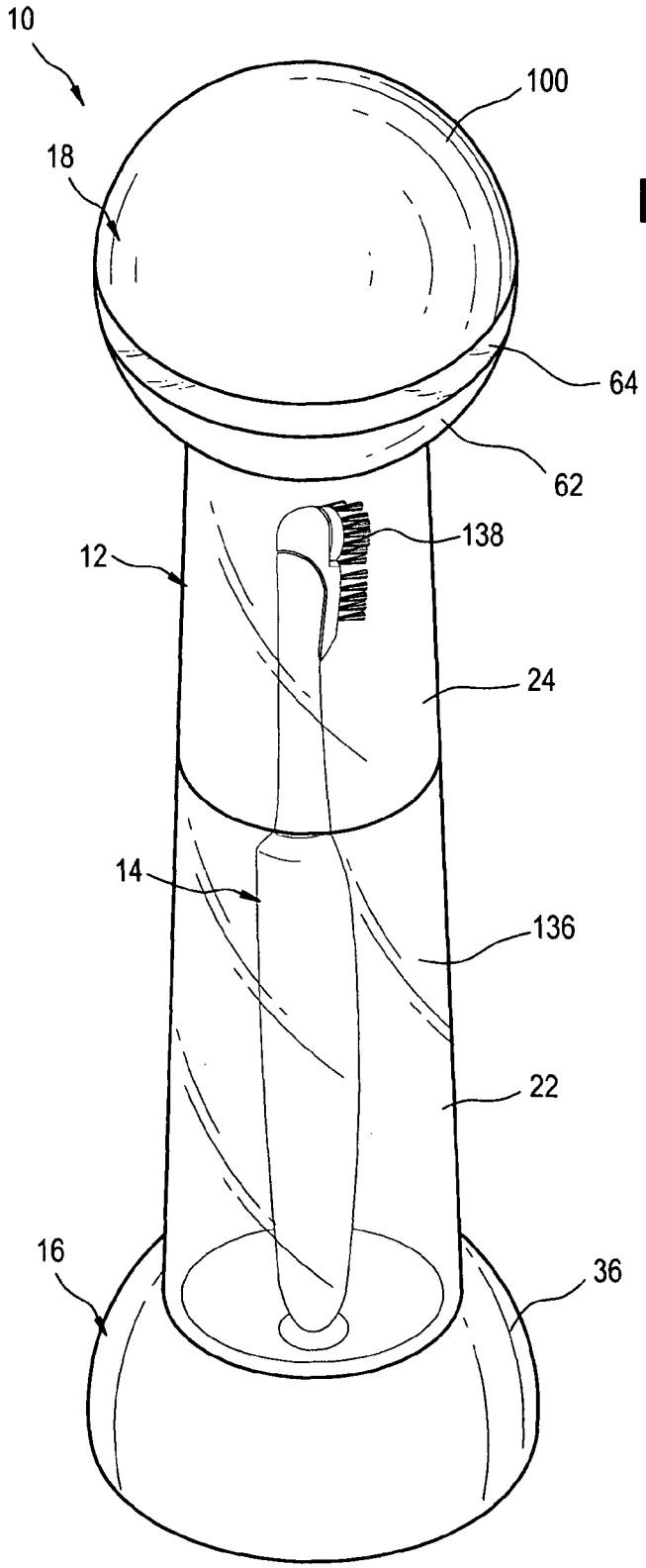
FIG. 1 is a perspective view of a toothbrush holder in accordance with the present invention.
Figure 2:
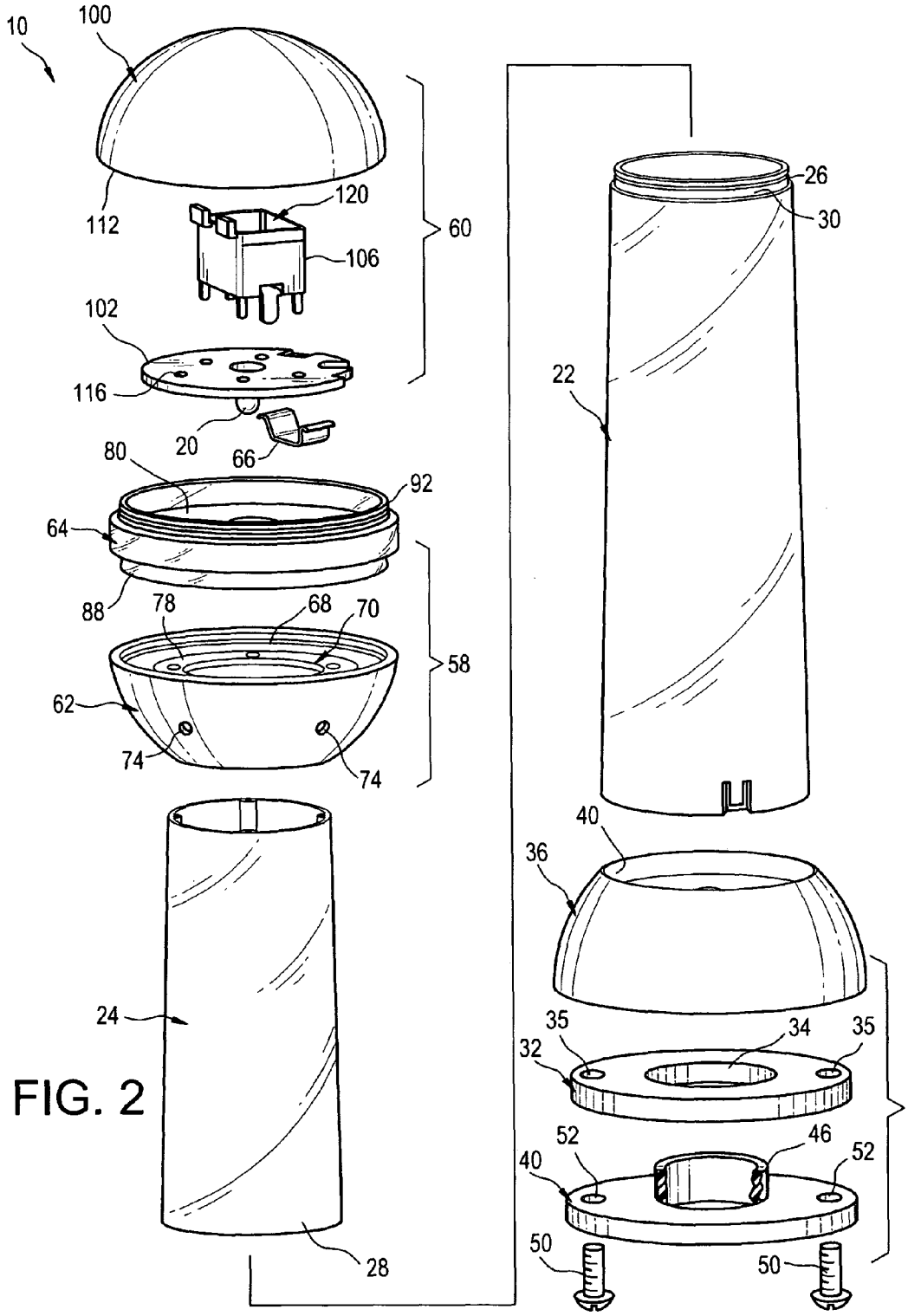
FIG. 2 is an exploded perspective view of the toothbrush holder of FIG. 1.
Figure 3:
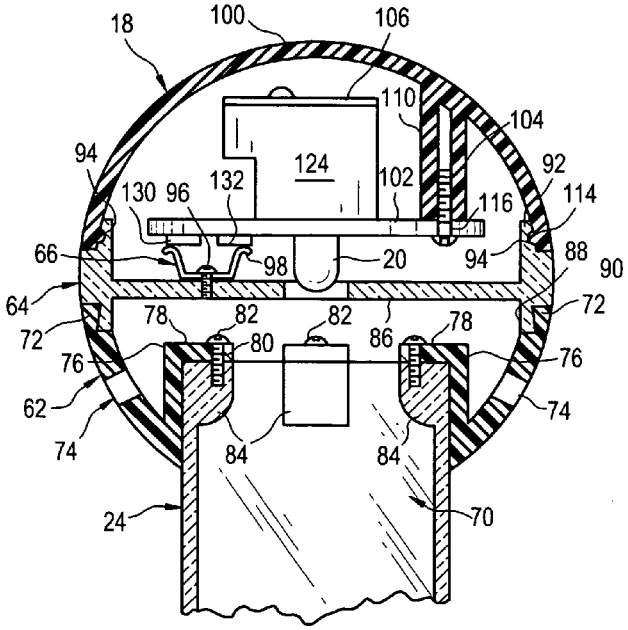
FIG. 3 is a cross-sectional view of the top portion of the toothbrush holder revealing details of the cap.
Figure 4:
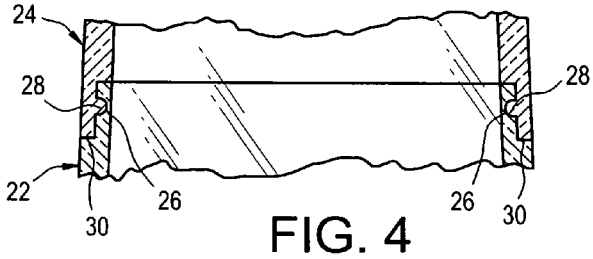
FIG. 4 is a cross-sectional view of the middle portion of the toothbrush holder revealing details of the connection between the upper and lower segments of the tubular body.
Figure 5:
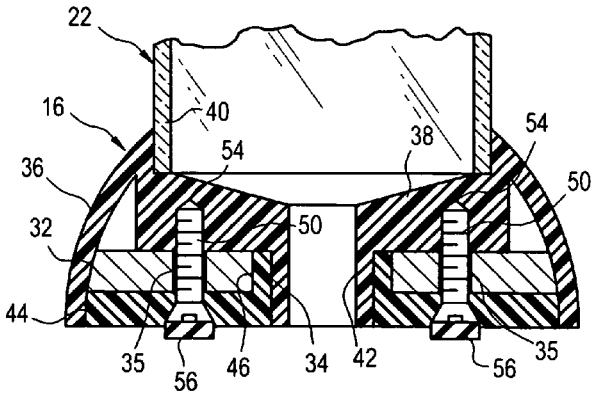
FIG. 5 is a cross=sectional view of the bottom portion of the toothbrush holder revealing details of the weighted base.
Figure 6:
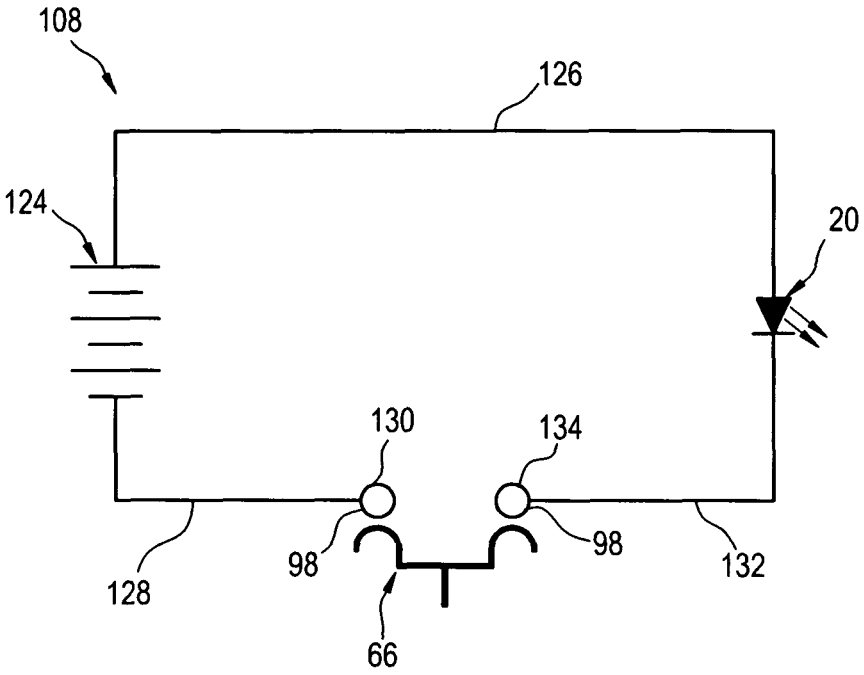
FIG. 6 is a schematic electrical circuit diagram of the toothbrush holder.

Referring now to the FIGS., a toothbrush holder having illuminating means in accordance with the present invention is shown at 10. The toothbrush holder 10 includes a tubular body 12 that is sized to contain a toothbrush 14. The bottom the tubular body 12 is closed by a weighted base 16. The top of the tubular body 12 is closed by a bulbous cap 18 that contains an LED 20 that can be selectively illuminated.

The tubular body 12 has a lower segment 22 and an upper segment 24 that are stacked upon one another and are formed of transparent plastic. The tubular body 12 has a height of about  inches ( cm) and an inner diameter of about  inches ( cm) being dimensions sufficient to contain the toothbrush 14. For added stability, the lower segment 22 is about twice as tall as the upper segment 24. The diameters of the segments 22 and 24 are also gradually reduced so as to provide the tubular body 12 with a shape resembling an elongated, inverted funnel.

The lower segment 22 separates from the upper segment 24 with a "snap". To facilitate a snap-fit between the segments 22 and 24, the lower segment 22 is provided with an outwardly opening, peripheral groove 26 around the top thereof. The upper segment 24, on the other hand, has an inwardly directed flange 28 around the bottom thereof that is adapted to fit snugly into the groove 26. The resilience of the plastic utilized to form the segments 22 and 24 permits the flange 28 to be selectively inserted and withdrawn from the groove 26 with a "snap".

The upper segment 24 cannot be pushed so far down onto the lower segment 22 as to be wedged thereon or cracked. To these ends, the lower segment 22 has an outwardly directed shoulder 30 located beneath the groove 26. During use, the shoulder 30 engages the bottom edge of the upper segment 24 and acts as a stop to the downward movement to the upper segment 24 thereby preventing structural damage to the tubular body 12.

The base 16 is an assemblage of elements meant to connect a disk 32, serving as a stabilizing weight, to the bottom of the tubular body 12. The disk 32 is slightly larger in diameter than the bottom of the lower segment 22 and has an orifice 34 in its center and a number of smaller openings 35 positioned around the orifice 34. Atop the disk 32 is positioned a cover piece 36 having a central bowl 38 and an integral containment rim 40 that extends downwardly and outwardly from the bowl 38 so as to snugly receive the disk 32 therein. The bottom of the bowl 38 is conical in form and terminates in a spout 42 that extends downwardly into the orifice 34. A base piece 44 fits flush against the bottom of the disk 32 and has a tubular riser 46 at its center that extends upwardly into the orifice 34 and snugly receives the spout 42. A number of openings 48 are provided around the riser 46 through which threaded fasteners 50 are extended through registered openings 52 in the disk 32 and into helically threaded sockets 54 in the bottom of the bowl 38. Screwing the threaded fasteners 50 into the sockets 54 locks the disk 32 between the cover piece 36 and the base piece 44. Non-slip rubber pads 56 are secured to the bottom of the base piece 44 to hide the openings 48 and to prevent the holder 10 from sliding on a supporting surface.

The cap 18 has a mounting assembly 58 and a rotatable cover assembly 60 that is carried by the mounting assembly 58. The mounting assembly 58 is secured directly to the upper segment 24. The cover assembly 60 is snap-fit to the mounting assembly 58.

The mounting assembly 58 includes: a mounting member 62 that connects to the upper segment 24, a switch plate 64 that is secured atop the mounting member 62, and an electrically conductive spring 66 that is secured atop the switch plate 64. The mounting member 62 and switch plate 64 are formed of plastic. The spring 66 is formed of spring steel that may be plated to inhibit oxidation.

The mounting member 62 includes a cup 68 having an opening 70 in its center for snugly receiving the top of the upper segment 24. A number of teeth 72 are positioned around the top of the cup 68 and project inwardly therefrom. A number of air vents 74 are provided in the cup 68 with each being positioned between a pair of teeth 72. A number of tabs 76 project upwardly from the bottom of the cup 68 around the opening 70. From the top of each of the tabs 76, a finger 78 projects inwardly so as to rest atop the upper segment 24. One or more of the fingers 78 is provided with a small hole 80 for the passage of a threaded fastener 82 into a socket member 84 in the upper segment 24. When tightened, the threaded fastener 82 locks the mounting member 62 onto the upper segment 24.

The switch plate 64 is formed of transparent plastic, a light transmissive material. Preferably, the switch plate 64 is a flat platter 86 with an outer diameter that is slightly larger than that of the cup 68 at its largest. A centralizing ring 88 projects downwardly from the bottom of the platter 86 into the top of the cup 68. A number of sockets 90 are spaced around the periphery of the ring 88 to receive the teeth 72 so as to secure the switch plate 64 to the cup 68. A centralizing band 92 projects upwardly from the top of the platter 86 and is sized to be received into the cover assembly 60. The centralizing band 92 has three slots 94 oriented about 120 degrees apart around the periphery thereof.

The conductive spring 66 is attached to the top of the platter 86 by means of a threaded fastener 96 passing through the center of the spring 66. The spring 66 has two resilient leaves 98 that extend upwardly from the opposite ends thereof. The leaves 98 serve as electrical contacts and the entirety of the spring 66 serves as a conductor for electrical current.

The rotatable cover assembly 60 is constructed from a number of discrete parts. The cover assembly 60 includes a cover member 100 and a circuit plate 102 formed of plastic and joined together by threaded fasteners 104. The assembly 60 also includes a plastic, battery box 106 affixed to the top of the circuit plate 102. An electrical circuit 108, minus the conductive spring 66, is provided on the circuit plate 102 and is connected to the battery box 106.

The cover member 100 is an inverted bowl. A number of socket members 110 are affixed to the bottom of the cover member 100. The socket members 110 extend downwardly from the cover member 100 but not below its rim 112. Three small, inwardly projecting teeth 114 are integrally formed with the cover member 100 and are snap-fit into the slots 94 when the holder 10 is assembled.

The circuit plate 102 is a flat disk. A number of holes 116 are provided in the circuit plate 102 for registration with the socket members 110. When extended through the holes 116 and tightened in the socket members 110, the threaded fasteners 104 lock the plate 102 within the cover member 100.

The battery box 106 is affixed to the top of the circuit plate 102. The battery box 106 is five-sided with an open top 120. Into the top 120 can be fitted three small batteries 124. Spring clips (not shown) retain the batteries 124 within the box 106.

The electrical circuit 108 that selectively illuminates the LED 20 is simple. The circuit 108 includes a pair of electrical leads 126 and 128 that are connected to the opposite poles of the batteries 124 and that extend outwardly from the battery box 106. The lead 126 is connected to the positive side of the LED 20. The other lead 128 is connected to an electrical contact 130 provided on the bottom of the circuit plate 102. A third lead 132 connects the negative side of the LED 20 to an electrical contact 134 positioned on the bottom of the circuit plate 102 adjacent the contact 130. To close the circuit 108, the cover member 100 is manually rotated to bring the contacts 130 and 134 into electrical communication with the spring 66 thereby energizing the LED 20. Opening the circuit 108 to deenergize the LED 20, is accomplished by rotating the cover member 100 in the opposite direction.

The use of the toothbrush holder 10 is straightforward. First, the tubular body 12 is opened by pulling the upper segment 24 gently away from the lower segment 22, (The segments 22 and 24 will separate with a "snap." Then, the toothbrush 14 is positioned with its handle 136 in the lower segment 22 and the upper segment 24 is placed over the bristles 138. Now, the segments 22 and 24 are pressed lightly together so that the flange 28 "snaps" into the groove 26. The toothbrush 14 is now enclosed and protected from contamination from germs. Removal of the toothbrush 14 from the holder 10 when needed from brushing is accomplished simply by reversing the steps just described.

The toothbrush 14, if wet, will dry within the holder 10. The circulation of air within, and through, the holder 10 is facilitated by the spout 42 in the base 16 and the vents 74 in the cap 18. Air typically passes through the tubular body 12 in the manner of a chimney from the spout 42 to the vents 74. Excess water transported into the holder 10 on the toothbrush 14 does not puddle within the base 16 but drains therefrom through the spout 42.

If it is desired that the holder 10 be used as a light source, this is done simply by manually rotating the cover assembly 60 relative to the mounting assembly 58. A rotation of just a few degrees brings the contacts 130 and 134 into engagement with the spring 66 and closes the electrical circuit 108. With electrical current free to flow from the batteries 124 to the LED 20, the LED 20 is brightly illuminated. Light from the LED 20 passes outwardly from the holder 10 through the transparent plastic of the switch plate 64 and tubular body 12. The LED 20 produces much light while requiring little electrical energy to operate, thus the LED 20 can be illuminated by the batteries 124 for many hours. The holder 10 therefore, makes a great nightlight.

Turning off the LED 20, is simple. It is accomplished by rotating the cover assembly 60 relative to the mounting assembly 58 so that the contacts 130 and 134 are not engaged with the spring 66. With the circuit 108, thus, open, electrical current cannot flow between the batteries 124 and the LED 20. To facilitate the opening and closing of the circuit 108, indicia (not shown) can be provided on the exteriors of the switch plate 64 and the cover member 100 to show their relative rotational positions.

The batteries 124 can be replaced when they are run down by disengaging the cover assembly 60 from the mounting assembly 58. To do this, the cover member 100 is forcefully twisted to withdraw the teeth 114 from the slots 94. Next, the threaded fasteners 118 are unscrewed from the socket members 110. Now, with the circuit plate 102 free and the battery box 106 exposed, the discharged batteries 124 are removed from the battery box 106 and are replaced with fresh batteries 124. Afterward, the threaded fasteners 118 are screwed back into the socket members 110 to reattach the circuit plate 102 to the cover member 100 and the teeth 114 are snapped back into their associated slots 94.

The toothbrush holder 10 is easily cleaned by removing the cover assembly 60, containing the electrical circuit 108 which should not get wet, from the balance of the holder 10. Removal is afforded by twisting the teeth 114 from the slots 94. Once accomplished, the remainder of the holder 10 is submerged in soapy water and scrubbed clean with a soft brush. Afterward, the holder 10 is wiped with a dry cloth to prevent water spots and reassembled. The cleaning process requires just a few minutes to complete and should be undertaken every few days or when it appears necessary to a user. After cleaning, the holder 10 is ready for immediate reuse. To maintain the cleanliness of the holder 10, excess water should always be shaken from the toothbrush 14 before placing it into the tubular body 12.

It will be appreciated by those skilled in the field that numerous modifications can be made to the toothbrush holder 10. For example, its dimensions can be expanded to contain numerous toothbrushes. It is, therefore, to be understood that my invention is not limited merely to the toothbrush holder 10 described above, but encompasses any and all toothbrush holders within the scope of the following claims.

I claim:

1. A toothbrush holder, comprising:

a tubular body being sized to contain a toothbrush, said tubular body being formed of a light-transmissive material and having:

a lower segment, and;

an upper segment with a top of the lower segment being releasably secured to a bottom of said upper segment;

a weighted base being affixed to the bottom of said lower segment;

a cap being affixed to the top of said upper segment and being formed of a light-transmissive material; and, a light source being secured within said cap.

2. The toothbrush holder according to claim 1 wherein said upper segment is snap-fit onto said lower segment.

3. The toothbrush holder according to claim 1 wherein said weighted base has a spout for funneling liquids received from the interior of said tubular body outwardly from said weighted base.

4. The toothbrush holder according to claim 3 wherein said cap is provided with at least one air vent for promoting the circulation of air from said spout and through said tubular body.

5. The toothbrush holder according to claim 1 wherein said light source is a battery-powered LED.

6. A toothbrush holder according to claim 1 wherein said cap includes:

a mounting assembly being positioned atop, and being affixed to, said upper segment, said mounting assembly including:

a switch plate; and, an electrically conductive spring being secured atop said switch plate, said spring having a pair of leaves extending upwardly from said switch plate;

a cover assembly being positioned atop, and being rotatably secured to, said mounting assembly, said cover assembly including:

a circuit plate disposed parallel to said switch plate and being adapted for manual rotation above said switch plate;

an open electrical circuit being secured to said circuit plate, said open electrical circuit including:

an electrical current source being secured atop said circuit plate;

an LED being selectively connected to said electrical current source and being secured to the bottom of said circuit plate;

a pair of electrical contacts being secured to the bottom of said circuit plate, said contacts being connected in electrical series with said LED, said contacts being adapted to touch said leaves, close said circuit, and illuminate said LED when said circuit plate is manually rotated to a first position relative to said switch plate; and said contacts being adapted to not touch said leaves, open said circuit, and deenergize said LED when said circuit plate is manually rotated to a second position relative to said switch plate.

* * * * *